United States Patent [19]

Thornley

[11] Patent Number: 5,023,406

[45] Date of Patent: Jun. 11, 1991

[54] HIGH VOLTAGE INSULATOR

[75] Inventor: David W. M. Thornley, Maimesbury, England

[73] Assignee: Raychem Limited, Swindon, England

[21] Appl. No.: 437,325

[22] Filed: Nov. 17, 1989

Related U.S. Application Data

[63] Continuation of Ser. No. 307,871, Feb. 7, 1989, abandoned.

[30] Foreign Application Priority Data

Feb. 8, 1988 [GB] United Kingdom ..... 8802841

[51] Int. Cl.[5] ..... H01B 17/32; H01B 17/50; H01B 17/60

[52] U.S. Cl. ..... 174/209; 29/631; 174/211; 174/212

[58] Field of Search ..... 174/80, 139, 178, 195, 174/209, 210, 211, 212; 29/631

[56] References Cited

U.S. PATENT DOCUMENTS 4,053,707 10/1977 Ely et al. ..... 174/209

OTHER PUBLICATIONS (S03650016), Ghare, D. B. et al., "Development of Composite Insulators for High Voltage Lines", paper presented at Conference on Progress in Cables and Overhead Lines for 220 KV and above, London, England, Sep. 4–6, 1979, five pages numbered 73–77.

Raychem Corporation Product Bulletin, 9/85 "Creepage Extenders–A Solution to Pollution Flashover Problems".

*Primary Examiner*—Laramie E. Askin

*Attorney, Agent, or Firm*—Edith A. Rice; Herbert G. Burkard

[57] ABSTRACT

A high voltage porcelain insulator has a plurality of sheds extending laterally thereof at spaced apart locations therealong. The creepage path length of the shedded insulator is extended by mounting polymeric insulating creepage extenders on the porcelain sheds. The creepage extenders do not extend completely around the periphery of the sheds but leave a gap. Preferably the gaps of adjacent creepage extenders along the insulator are not aligned.

11 Claims, 2 Drawing Sheets

HIGH VOLTAGE INSULATOR

This application is a continuation of application Ser. No. 07/307,871 filed Feb. 7, 1989, now abandoned.

This invention relates to a high voltage insulator and its method of manufacture. In particular, the invention relates to improving the resistance to flow of creepage current along the length of a high voltage insulator and reducing its tendency to flashover. By high voltage is meant a voltage in excess or 1 kV, for example in excess of 15 kV or 25 kV.

The term "insulator" is to be understood as including not only an electrical component that is made substantially entirely of insulating material, but also a component, such as a surge arrester, that, whilst having an insulating outer surface, may at some stage of its operation become conductive.

A typical porcelain insulator comprises a solid cylindrical core of porcelain with a plurality of integral porcelain sheds extending circumferentially therearound, the core being cemented and/or mechanically secured to a metal fitting at each end for electrical connection to the insulator. The length of the insulator, and the number and diameter of the sheds, are chosen in dependence on the operating voltage of the insulator and on its operating environment, those parameters increasing the higher the operating voltage and the more severe the operating environment, in terms of pollution due to water, acids, and salts for example.

The performance of such an insulator may be improved in several ways. For example, a so-called creepage extender, available from Raychem, may be bonded to each of the sheds. The creepage extender, made of polymeric material, and arranged to be recoverable, is of annular configuration, is positioned over the shed, heated so as to effect its thermal recovery, and guided onto the shed such that the rim of the shed is bonded to an internal, adhesive-coated groove of the creepage extender. The circumferentially-extending annular surface of the creepage extender significantly increases the path length that any creepage currents have to follow from one end fitting (at high voltage) to the other end fitting (at a much lower voltage, for example earth potential) of the insulator. Such creepage extenders, being of annular configuration, may be mounted on the porcelain shed of the insulator either before or after attachment of the end fittings, since these fittings are usually not of large diameter and the extender will pass over them. However, once such a porcelain insulator has been connected into an electrical system, the creepage extender cannot be added without disconnection at the end fittings to allow it to be slipped over the core. This can be inconvenient, time consuming and expensive.

A polymeric wraparound device is described in UK Patent No. 1,542,845, and corresponding U.S. Pat. No. 4,058,707 that enhances the performance of a porcelain insulator, but in a totally different manner and for a totally different purpose from that of the creepage extender. This device, known as a booster shed and available from Raychem, is wrapped around the core of an insulator in the region of one of its porcelain sheds and overlaps itself at its free ends which are then interengaged by a pop-stud fastening arrangement. It is a specific feature of the functioning of the booster shed that in order to reduce the probability of flashover between the end fittings of the insulator under heavy wetting conditions, it be spaced away from the surface of the porcelain shed. With a creepage extender on the other hand, which is designed to operate under both light and heavy wetting conditions, it is very important to ensure a good bond with the porcelain shed so that any leakage currents flow along the surface of the extender, and not through the bond with the porcelain (which would thus not result in extending the creepage path length).

Accordingly, there remains a requirement for a component that can be added to an existing shedded insulator, of porcelain, glass, epoxy resin or other material after the insulator has been connected to form part of an electrical system, whereby resistance to the flow of creepage current along the insulator is enhanced.

In accordance with one aspect of the present invention, there is provided an elongate high voltage electrical insulator comprising an elongate core having at least one shed extending laterally completely therearound, and one or more components of insulating, and preferably substantially nontracking, material bonded to the shed and extending laterally therefrom around part only of the perimeter of the shed, thereby to increase the longitudinal creepage path length of the shedded core around part only of the core perimeter.

In accordance with another aspect of the present invention, there is provided a method of increasing the longitudinal creepage current resistance of an elongate high voltage electrical insulator, the insulator comprising an elongate core having at least one shed extending laterally completely therearound, wherein one or more components of insulating and preferably substantially non-tracking, material are bonded to the shed so as to extend laterally therefrom around part only of the perimeter of the shed, thereby to increase the longitudinal creepage path length of the shedded core around part only of the core perimeter.

Very surprisingly, and contrary to expectations, it has been found that even though the added insulating component, or all the insulating components, do not extend completely peripherally around the insulator, there being one or more gaps, the leakage current does not flow solely through the gap(s), thus by-passing the added component(s), but the added component(s) remains effective, to a surprising degree, at increasing the creepage resistance of the insulator. Consequently, a wraparound form of creepage extender, for example, may be employed without the need for any bonding between the free ends thereof, which do not need to overlap. Thus, the problem of bonding at such an overlap is obviated. It will be understood that the shortest creepage path length between the end fittings of an insulator in accordance with the present invention is not necessarily enhanced by the added component(s), but since the creepage current is the total of current flow at all peripheral points, and since the creepage path length is enhanced at at least some peripheral points, the overall creepage resistance is increased and thus the total creepage current is decreased, for a given voltage The bonding of the added insulating component(s) to the shed is understood to be such that substantially no creepage current is able to flow through the bond, and thus flows substantially over the shed or added insulating component(s).

Preferably the total peripheral annular gap is not more than 90° of arc, and advantageously is between 5° and 30° of arc, and can be even smaller. The shape of the gap(s) is not important, thus it need not be a segment of a circle, and the opposing edges of the polymeric component(s) may be parallel to each other for example.

In accordance with the present invention, the creepage current resistance of the shedded insulator can be improved significantly by the addition of one or more insulating components around at least 270° of arc. However, as the peripheral gap is reduced, the performance of the insulator in terms of creepage resistance does improve until performance not significantly different from a 360° creepage extender is achieved even though a peripheral gap does exist.

A single added insulating component may be employed, or two or more components may be bonded to the shed at symmetric or asymmetric locations therearound Advantageously the insulating component(s) is grooved to fit over the rim of the shed, and the groove may contain an adhesive or sealant.

Preferably the insulating component(s) is made of polymeric material, but it may be of refractory material, such as porcelain, or other insulating material. It may be simply wrapped around the shed and bonded thereto, or it may be recoverable, for example by the application of heat thereto, and be recovered into bonding engagement with the shed.

The insulator may have a plurality of (i.e. two or more) sheds, each of which may have one or more such insulating components associated therewith. Typically such an insulator is mounted vertically, or at least inclined to the horizontal, and advantageously the gap(s) between the insulating component(s) on one shed are not in alignment with the gap(s) between the insulating component(s) of an immediately adjacent shed. Such offsetting maximises the increase in creepage current resistance of the insulator.

Typically, the enhanced longitudinal creepage path length for each shed would be about 2×50 mm, 50 mm being the typical overhang of the additional insulating component beyond the insulator shed. The creepage extending component would typically have an effective diameter between about 100 mm and 300 mm, depending on the shed diameter of the insulator.

An insulator and method, each in accordance with the present invention, will now be further described, by way of example, with reference to the accompanying schematic drawings, in which.

Figure 1:
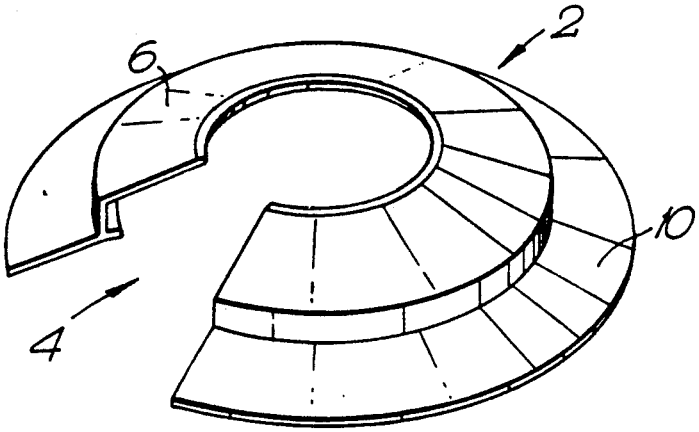
FIG. 1 is a perspective view of a wraparound creepage extender of the insulator.
Figure 2:
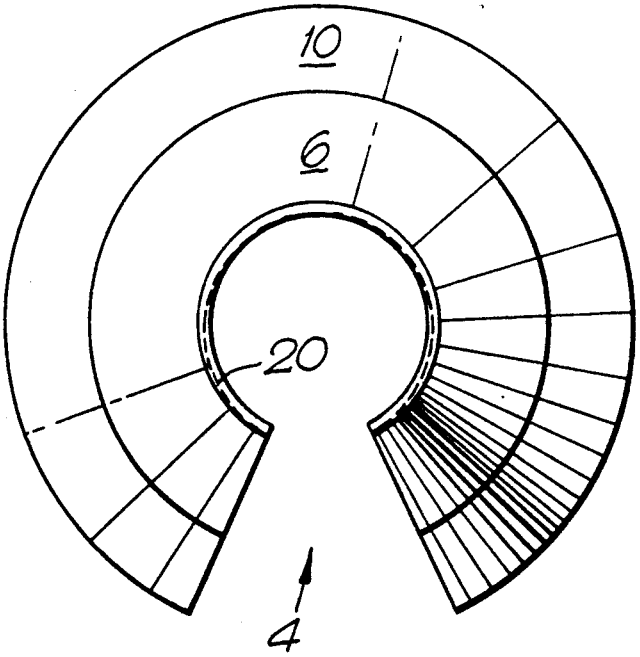
FIG. 2 is a plan view of the wraparound creepage extender of FIG. 1
Figure 3:
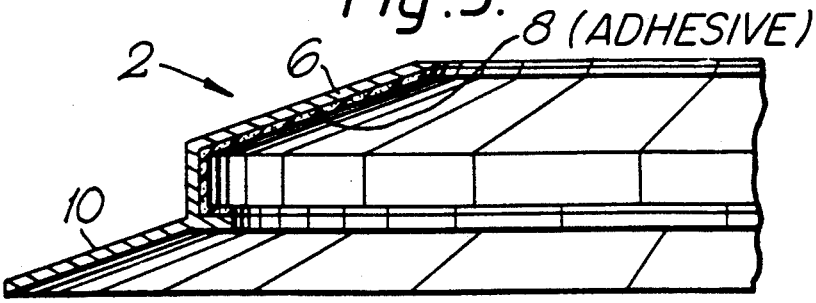
FIG. 3 is a sectional elevation through part of wraparound creepage extender of FIG. 1.

Referring to FIGS. 1, 2 and 3, the wraparound creepage extender 2 is of generally part conical configuration, and is formed from insulating, non-tracking and weather-resistant polymeric material. It has a generally circular section, with a gap 4 formed by a segment of about 5° of arc. The creepage extender 2 has an upper portion 6 (FIG. 3) having an internal groove coated with a hot melt adhesive 8, and a lower portion 10 extending away therefrom. The creepage extender 2 is formed so as to be recoverable, in this instance radially shrinkable, by the application of heat thereto.

Figure 4:
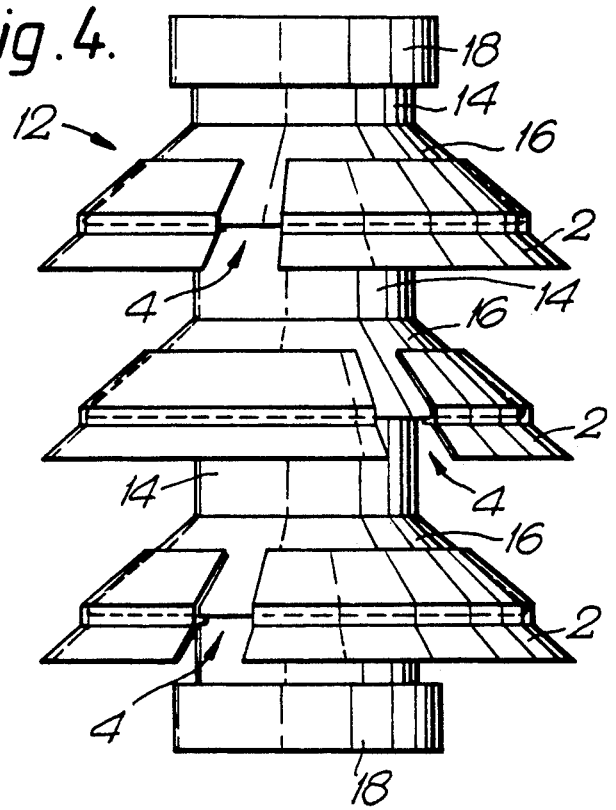
FIG. 4 is an elevation of an insulator comprising a plurality of sheds and wraparound creepage extenders.

FIG. 4 shows an insulator 12 having a cylindrical core 14 and three integral sheds 16, all of porcelain. The core 14 is cemented into a metal end fitting 18 at each end. A wraparound creepage extender 2 is mounted on each of the sheds 16, and is secured in position by disposing the upper portions 6 around the rims of the respective sheds 16 and applying heat to effect recovery, i.e. radial shrinkage, of that portion and also to cause the adhesive 8 to melt and flow to achieve the necessary bonding of the creepage extenders to the sheds. Although the creepage extenders 2 are substantially identical, they are positioned on their respective sheds 16 such that their gaps 4 are vertically offset from each other. Accordingly, even the geometrically shortest creepage path between the end fittings 18 does not lie along a direct line. It will of course be appreciated that the gaps 4 can advantageously be offset further from each other, for example by a maximum of 120° of arc for the three-shed insulator shown.

In order to avoid the accumulation of moisture, dirt and other pollutants around the porcelain core 14 on top of the creepage extenders 2, the uppermost surface of each creepage extender is advantageously chamfered inwardly towards the core 14 and downwardly towards the gap 4. Thus, suitable contouring of the extender 2 can advantageously exist inside the broken line 20 of FIG. 2.

It will be appreciated that instead of a single creepage extender being mounted on each shed, two extenders, for example each covering 175° of arc may be mounted therearound with a 5° gap at each end thereof, or a larger number of extenders may be employed. Furthermore, in a stacking arrangement having two of more sheds, the peripheral gap size may vary from one shed to another.

In some instances, it may be desirable to secure the ends of the creepage extender together across the gap, and this may be done either only as a temporary measure whilst mounting, for example adhering and/or heat shrinking, of the extender on the insulator shed is being completed, or it may be done so as to secure the ends together permanently. This may be done in any convenient manner.

Figure 5:
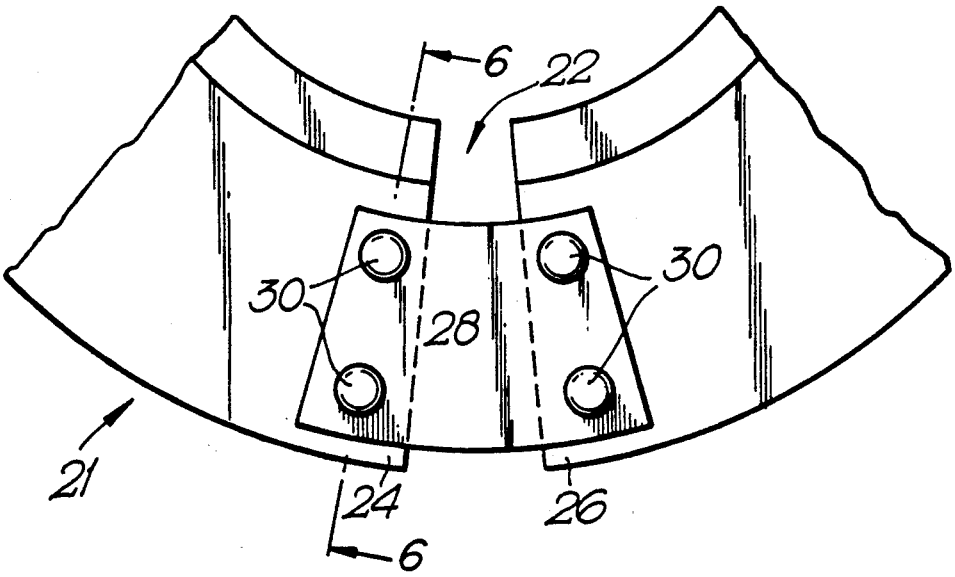
FIG. 5 is a plan view of a portion at a gap of another embodiment of a wraparound creepage extender.
Figure 6:
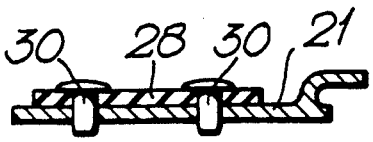
FIG. 6 is a sectional view along the line 6—6 of FIG. 5.

Referring to FIGS. 5 and 6, the creepage extender 21 has a gap 22 between opposing ends 24 and 26 thereof. A bridge 28 of insulating material is secured by fasteners 30 to the ends 24 and 26 of the extender 21 and secures these together across the gap 22.

Some tests were carred out to compare the effectiveness of shedded insulators without any creepage extenders added with insulators having full annular extenders mounted thereon, and with insulators in accordance with the present invention having mounted thereon creepage extenders with gaps. Two basic insulators were used, Control 1 and Control 2, having nominal creepage path lengths of 720 mm and 1500 mm respectively. They were mounted in a chamber whose atmosphere could be carefully controlled and which was arranged to be a fog of 8% salinity, in accordance with the IEC specification 507 test at 8% salt. The voltage across the ends of the insulators was noted at which flashover between the terminals occurred. Extenders were added as mentioned and as set out below, and the test repeated. In the samples having creepage extenders with a gap in the periphery, the gap in each case was of 15 mm. The table below shows the results obtained:

TABLE

| | Creepage path length (mm) | Flashover Voltage (kV) |
|---|---|---|
| Control 1 (no extenders) | 720 | 21.1 |
| Control 1 + 2 Annular Extenders | 920 | 27.2 |
| Control + 2 Gapped Extenders | 920* | 25.3 |
| Control 2 | 1500 | 38 |
| Control 2 + 4 Annular Extenders | 1900 | 48 |
| Control 2 + 4 Gapped Extenders | 1900* | 50 |

* This is the nominal creepage path length over the extender portions. If all slots were aligned, the direct path length therealong would be as for the Control.

For each insulator, it can be seen that the gapped configuration gives a result that is significantly better than for the control and that is comparable with that of an insulator having annular extenders that completely surround the periphery of the insulator.

What is claimed is:

1. An elongate high voltage electrical insulator comprising an elongate core having at least one shed extending laterally completely therearound, and one or more components of insulating material bonded to the shed and extending laterally therefrom around part only of the perimeter of the shed, thereby to increase the longitudinal creepage path length of the shedded core around part only of the core perimeter.

2. An insulator according to claim 1, wherein the or all the insulating components leave a peripheral gap around the shed that totals not more than 90° of arc.

3. An insulator according to claim 2, wherein the peripheral gap is between 5° and 30° of arc.

4. An insulator according to claim 1, consisting of only one of said components which is wrapped around the shed.

5. An insulator according to claim 1, wherein the or each insulating component is made from polymeric material.

6. An insulator according to claim 5 wherein the or each polymeric component is recovered onto the shed.

7. An insulator according to claim 1, comprising a plurality of said sheds, each of which has at least one of said insulating components bonded thereto.

8. An insulator according to claim 7, wherein the or each peripheral gap associated with any one of the sheds is not aligned, around the periphery of the core, with the or each peripheral gap associated with an immediately adjacent shed.

9. An insulator according to claim 1 wherein the core and said at least one shed is formed from porcelain.

10. A method of increasing the longitudinal creepage current resistance of an elongate high voltage electrical insulator, the insulator comprising an elongate core having at least one shed extending laterally completely therearound, comprising the step of bonding one or more components of insulating material to the shed so as to extend laterally therefrom around part only of the perimeter of the shed, thereby to increase the longitudinal creepage path length of the shedded core around part only of the core perimeter.

11. A method according to claim 10, including forming the or each insulating component of recoverable material and recovering the or each insulating component onto the shed.

* * * * *